United States Patent [19]

Goldman

[11] Patent Number: 4,747,628

[45] Date of Patent: May 31, 1988

[54] SAFE LOCKING SYSTEM ELEMENTS STRUCTURE

[75] Inventor: Ilan Goldman, Kfar Shmaryahu, Israel

[73] Assignee: Toot (Engineering) Ltd., Israel

[21] Appl. No.: 62,511

[22] Filed: Jun. 15, 1987

[30] Foreign Application Priority Data

Jun. 19, 1986 [IL] Israel ..... 79162

[51] Int. Cl.[4] ..... E05C 3/10

[52] U.S. Cl. ..... 292/51; 292/199

[58] Field of Search ..... 292/220, 199, 25, 51, 292/96, 142, DIG. 7, 202; 74/422

[56] References Cited

U.S. PATENT DOCUMENTS

| | | | |
|---|---|---|---|
| 1,131,247 | 3/1915 | Kiekert | 292/51 |
| 2,900,678 | 8/1959 | Curtis | 292/202 X |
| 4,541,293 | 9/1985 | Caugant et al. | 74/422 X |

FOREIGN PATENT DOCUMENTS

| | | | |
|---|---|---|---|
| 250055 | 4/1961 | Australia | 292/340 |

*Primary Examiner*—Richard E. Moore

*Attorney, Agent, or Firm*—Ostrolenk, Faber, Gerb & Soffen

[57] ABSTRACT

A safe door locking system comprising a pinion rotatably mounted inside the door, and a door operating handle wheel at the outside of the door which is drivingly coupled to the pinion. A rack bar is coupled, via a gear mesh to the pinion. The door is adapted to lock by a plurality of in-unison rotatable disc-like lock bolts coupled to the rack bar. The rack is of hybrid structure, constituted by a double-T profiled, non-ferrous metal extruded bar. Inside one of its elongated cavities, at appropriate intervals as determined by the location of the said lock bolts, there are fastened a respective number of gear-toothed inserts meshed with the said lock bolts. An additional gear-toothed insert is fastened inside the other of the elongated cavities, meshing with the pinion. The pinion, the inserts, and the disc lock bolts are all made by slicing off extruded non-ferrous metal bars of suitable shapes, as the case may be.

8 Claims, 3 Drawing Sheets

FIG. 2
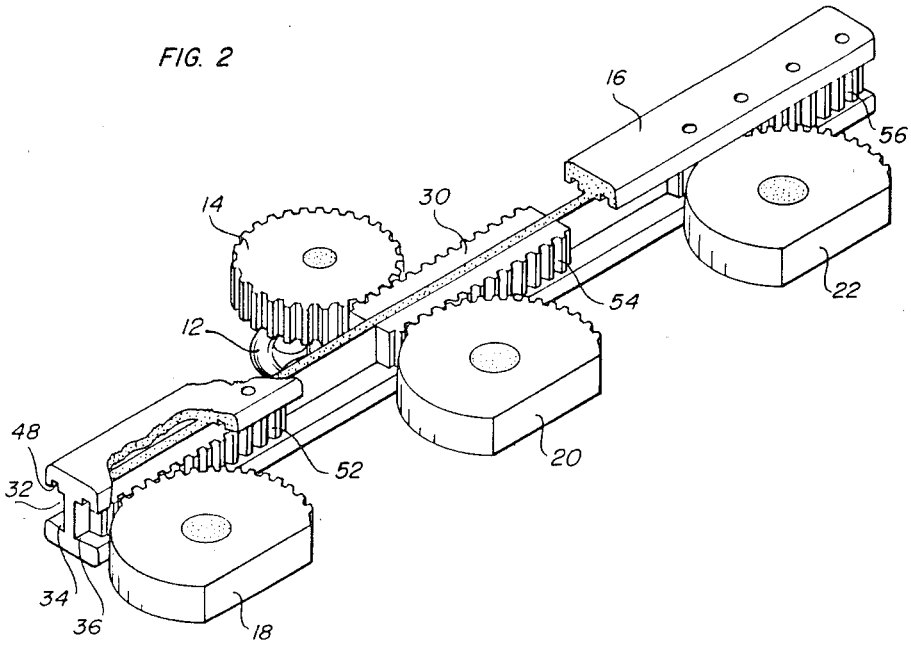
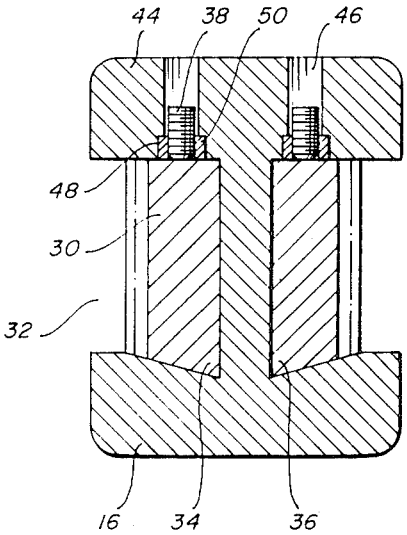
FIG. 3

FIG. 4
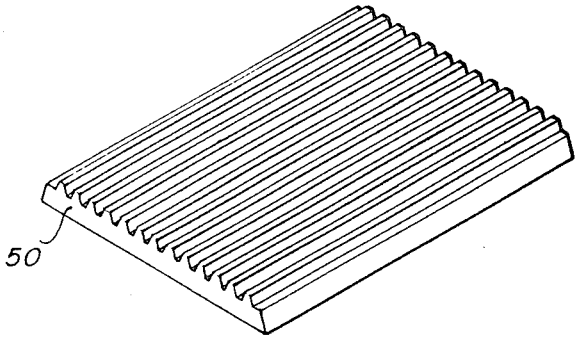
FIG. 5
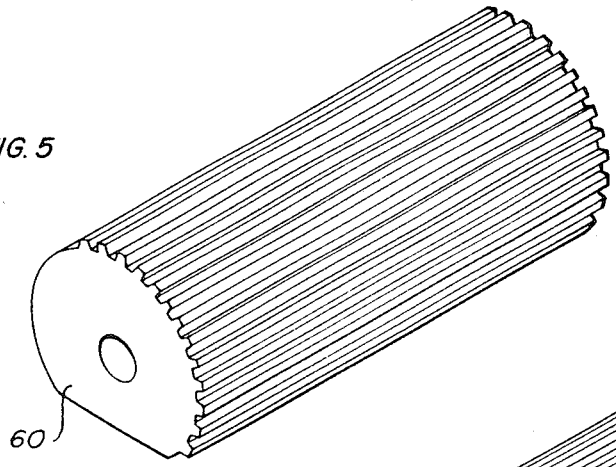
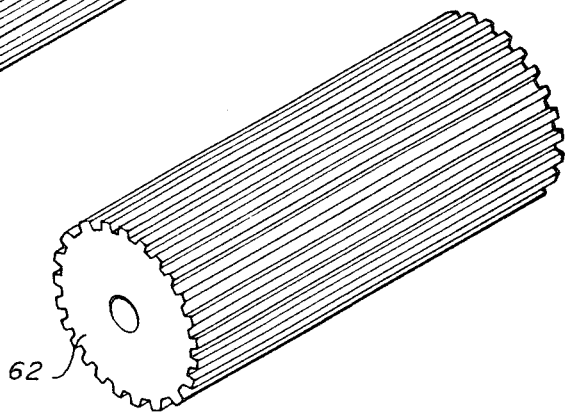
FIG. 6

SAFE LOCKING SYSTEM ELEMENTS STRUCTURE

BACKGROUND OF THE INVENTION

The present invention relates to safes, strongboxes, vaults, and the like, and more particularly to door locking systems thereof.

There are known in the art many types of locking systems, such as that disclosed in U.S. Pat. No. 4,432,573 and many others, which are basically comprised of an elongated, unitary operating bar which extends substantially all along the safe door. The bar is coupled on the one hand to a manipulable system of the safe, i.e. to the operating handle provided at the outside of the door, and, on the other hand, to a plurality of lock bolts for simultaneous driving of the bolts when the bar is displaced.

The lock system of the present invention falls under this category of single-bar-multi-locks arrangement, and has for its major object to significantly reduce the production costs of its components, in the following respect: While in conventional systems, all parts were made of steel, machined or otherwise processed to make them suitable for their respective functions, it is proposed according to the concept of the present invention to fabricate as many as possible of the locking system parts by the technique of extrusion, namely to make use of non-ferrous extruded metal bars.

It has, in fact, been proved that parts made of such profiled bars are no less suitable for the purposes in question insofar as strength, durability and other mechanical properties are concerned.

In addition, it has been found that other advantages are attained regarding simplicity of manufacture and assembly of the system, as will be explained in detail further below.

SUMMARY OF THE INVENTION

According to the general aspect of the invention, there is provided a safe door locking system comprising a pinion rotatably mounted inside the door, and a door operating handle wheel at the outside of the door, which is drivingly coupled to the pinion. A rack bar is coupled, via a gear mesh to the pinion. The door is adapted to lock by a plurality of in-unison rotatable disc-like lock bolts coupled to the rack bar. The rack is of hybrid structure, constituted by a double-T profiled, non-ferrous metal extruded bar. Inside one of its elongated cavities, at appropriate intervals as determined by the location of the said lock bolts, there are fastened a respective number of gear-toothed inserts meshed with the said lock bolts. An additional gear-toothed insert is fastened inside the other of the elongated cavities, meshing with the pinion.

Preferably, the pinion, the inserts, and the disc lock bolts are all made by slicing off extruded non-ferrous metal bars of suitable shapes, as the case may be.

Further features of construction and advantages of the invention will become clearer in the light of the following description of a preferred embodiment thereof, given with reference to the attached drawings, wherein.

BRIEF DESCRIPTION OF THE DRAWINGS

FIG. 2 is a schematic, three-dimensional view of the operating bar and associated parts;

FIG. 3 is a section taken along line III—III of FIG. 1;

FIG. 4 shows a profiled bar suitable for producing the inserts;

FIG. 5 shows a profiled bar suitable for producing the lock discs; and

FIG. 6 shows a profiled bar suitable for producing the handle wheel.

DETAILED DESCRIPTION OF THE PREFERRED EMBODIMENT

Figure 1:
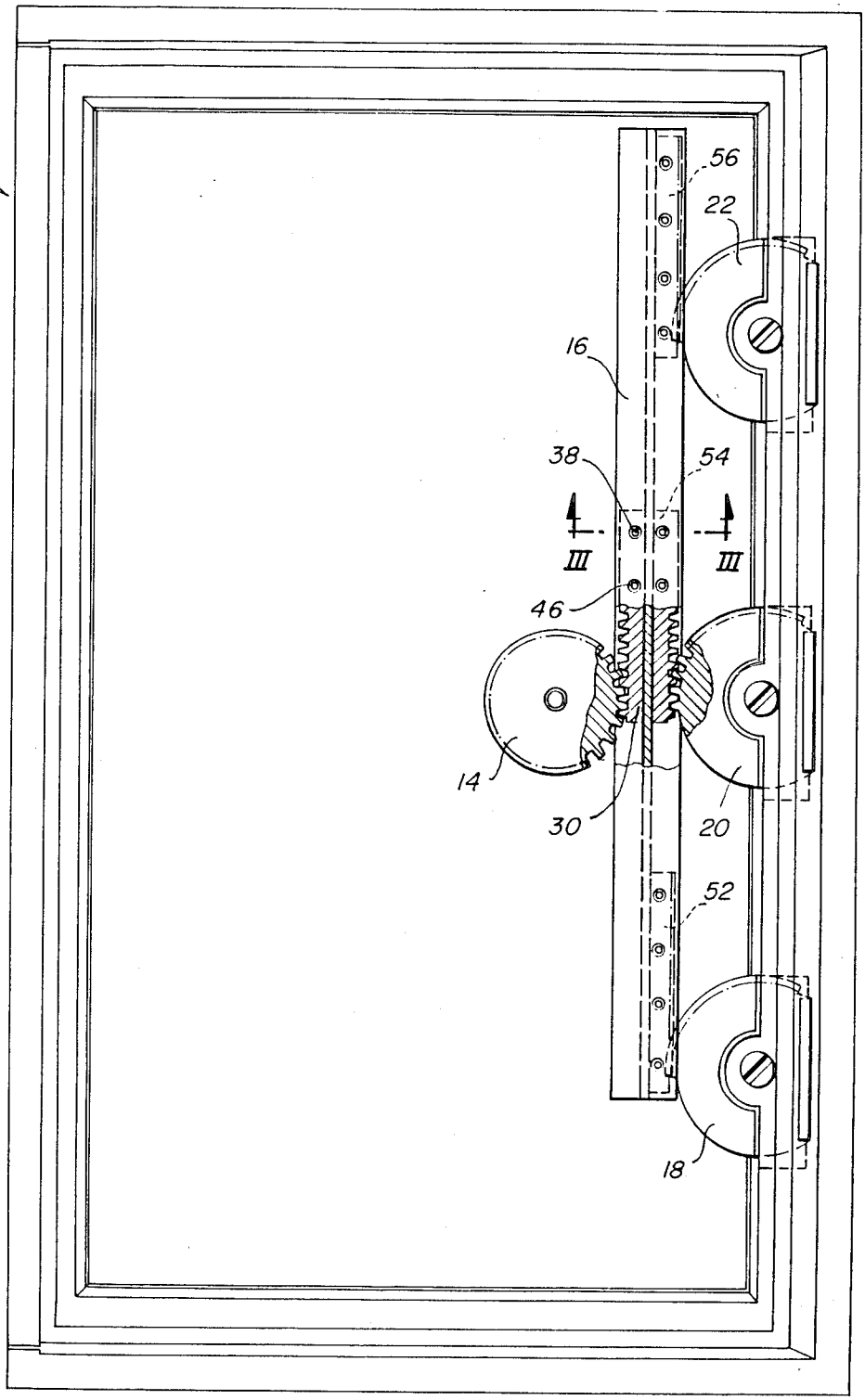
FIG. 1 is a general, top view of the system according to the present invention.

In FIG. 1, a safe door generally designated 10 is shown from its inner side, at which the locking system is installed. For the sake of clarity, parts and components of the system which necessarily exist in all cases but do not directly relate to the subject-matter of this invention, have been ommitted from the drawings.

So, the system discussed herein comprises handle wheel 12 (FIG. 2) coupled to pinion 14. The pinion 14 is gear-meshed to a lock bolt-operating bar 16. Three lock bolts in the form of partly toothed discs 18, 20, and 22, are mounted along the long side of the door.

In more detail, and as best seen in FIG. 2, the operating bar 16 has a double-T cross-section and is, according to a unique feature of the invention, extruded from a non-ferrous metal, usually aluminum.

A first gear-toothed insert in a form of a rack 30 is accommodated within elongated cavity 32 (FIG. 3) at one side of the bar 16. As best seen in FIG. 3, the bar 16 is of an asymmetrical cross-section, in that its lower inner corners marked 34 and 36 are slightly wedge-shaped. Thus, the insert 30 must in fact be threaded or slid from the open part of the elongated cavity 32 all the way down to its desired location, i.e. opposite the handle pinion 14. The same applies to the inserts at the other side of the bnar 16—see below.

To lock the insert in its respective location along the bar 16, stud screws such as 38 are used with respect to the insert 30. Since the bar is extruded, elongated depressions or channels 48 may easily be formed. The width of the depression is such that a standard hexagonal nut 50 will fit and become arrested against rotation thereof.

Bores 46 are drilled at the required locations; the screws 38 are threaded into the nuts 50 (which were inserted from below beforehand) and tightened to hold the insert 30 by friction in its place.

As already mentioned, the same arrangement applies to the remaining inserts 52, 54 and 56 associated with disc locks 18, 20 and 22, respectively.

It is again emphasized in this context that this specific profiling of the bar 16 is facilitated by its being extruded, as explained above.

The insert 30 is preferably sliced off an elongated profiled bar 50 shown in FIG. 4, again, conveniently produced by the extrusion of aluminum.

As for the disc-shaped lock bolts 18–22, it is again advisable to produce same from slices cut off a profiled bar 60 shown in FIG. 5, and the pinion 14 is sliced off an extruded bar 62.

In summary, it has been established that the proposed construction of the safe door system main parts, utilizing profiled bars of aluminum, presents a suprisingly adequate way of satisfying the specific design requirements of safe locking systems: it reduces manufacturing costs and also the overall weight of the completed articles—which, in itself, is considered an important advantage.

Those skilled in the art will readily understand that many changes and modifications may be applied to the invention without departing from its scope as defined in and by the appended claims.

What is claimed is:

1. A safe door locking system comprising a safe door having an inside and an outside, a pinion rotatably mounted on the inside of the door, a door operating handle wheel at the outside of the door and drivingly coupled to the pinion, a rack bar, a gear mesh coupling the rack bar to the pinion, and a plurality of in-unison rotatable, disc-like lock bolts coupled to the rack bar, the rack bar comprising a double-T profiled, non-ferrous metal extruded bar wherein the profile of the bar defines elongated cavities; inside one of the elongated cavities of the bar, at appropriate intervals as determined by the location of the lock bolts, there are fastened a respective number of gear-toothed inserts meshed with the said lock bolts, the gear mesh comprising an additional gear-toothed insert fastened inside the other of the elongated cavities and meshing with the pinion.

2. The system as claimed in claim 1 wherein the inserts are made by slicing off a profiled extruded non-ferrous metal bar.

3. The system as claimed in claim 2 comprising stud screws for fastening the inserts to the rack bar.

4. The system as claimed in claim 3 wherein the stud screws hold the insert by friction against a wedge-shaped corner of the bar.

5. The system as claimed in 4 wherein the screws are threaded into hexagonal nuts.

6. The system as claimed in claim 5 wherein the bar is formed with a longitudinal channel at the inner side of its upper T-section, the nuts being accommodated within the channel and accessible by the screw through bores drilled in the said upper section.

7. The system as claimed in claim 1 wherein the said disc-like lock bolts are made by slicing off a profiled extruded non-ferrous metal bar.

8. The system as claimed in claim 1 wherein the said pinion is made by slicing off a profiled extruded non-ferrous metal bar.

* * * * *